US010893745B2

(12) United States Patent
Beard

(10) Patent No.: US 10,893,745 B2
(45) Date of Patent: Jan. 19, 2021

(54) SYSTEM AND METHOD FOR LOADING PAINT CONTINUOUSLY TO A PAINT BRUSH

(71) Applicant: Charles Scott Beard, Port Neches, TX (US)

(72) Inventor: Charles Scott Beard, Port Neches, TX (US)

( * ) Notice: Subject to any disclaimer, the term of this patent is extended or adjusted under 35 U.S.C. 154(b) by 220 days.

(21) Appl. No.: 15/805,122

(22) Filed: Nov. 6, 2017

(65) Prior Publication Data

US 2019/0133310 A1 May 9, 2019

(51) Int. Cl.
*B05C 17/01* (2006.01)
*A46B 11/06* (2006.01)
*A46B 11/00* (2006.01)

(52) U.S. Cl.
CPC ..... *A46B 11/063* (2013.01); *A46B 11/0086* (2013.01); *A46B 11/002* (2013.01); *A46B 11/0006* (2013.01); *A46B 11/0024* (2013.01); *A46B 2200/202* (2013.01); *B05C 17/01* (2013.01); *B05C 17/0116* (2013.01); *B05C 17/0136* (2013.01); *B05C 17/0146* (2013.01)

(58) Field of Classification Search
CPC ..... A46B 11/063; A46B 11/0086; A46B 2200/202; A46B 5/0095; A46B 11/00; A46B 11/0006; A46B 2200/20; A46B 11/001; A46B 11/002; A46B 11/0024; B05C 17/0136; B05C 17/01; B05C 17/0116; B05C 17/0146; B05D 1/28; B05D 1/283
See application file for complete search history.

(56) References Cited

U.S. PATENT DOCUMENTS 2,041,022 A * 5/1936 Rassmussen ..... B44D 3/225 401/176
3,332,102 A * 7/1967 Brinker ..... A46B 11/063 401/270
3,715,099 A * 2/1973 Shendure ..... F16L 37/23 251/149.1
6,749,356 B1 * 6/2004 Mead ..... B05C 17/0136 401/176
7,182,538 B2 * 2/2007 Grosso ..... A46B 11/0055 401/171

* cited by examiner

*Primary Examiner* — David J Walczak
(74) *Attorney, Agent, or Firm* — Spradley PLLC; Michael Spradley

(57) ABSTRACT

An improved system and method for loading paint continuously to a paintbrush. A substantially cylindrical container can comprise a first orifice, a second orifice, a void, a plunger, a rod, a biasing device, and a paint-dispenser. The first orifice at a front end of the container. The second orifice at a back end of the container. The void that can be within the container can be fillable with the paint. The rod can be slidably mounted within the second orifice and the ring. The biasing device can be positionable into expanded state, and extracted state. Further, wherein the biasing device can move relatively to the amount of paint that can placed within the void. The paint-dispenser can be connectable with the container through a hose, the paint dispenser can comprise a button. The button once actuated can be capable of releasing the paint to a paintbrush bristles.

9 Claims, 21 Drawing Sheets

SYSTEM AND METHOD FOR LOADING PAINT CONTINUOUSLY TO A PAINT BRUSH

BACKGROUND

This disclosure relates to a system and method for loading paint continuously to a paintbrush.

Painting has been a widely known process of expressing creativity or a way of aesthetically improving an object or a surface. The process has not been improved and developed for many years. As an example scenario, a large surface such as a wall would require a painter to dip a paintbrush into a paint container and then apply the paint to the wall surface. The painter would need to repeat the same process of dipping the paintbrush and applying the paint until the entire wall surface is covered. Such process can be inconvenient, tiring, messy, and time-consuming. Another example scenario is when a hard-to-reach area such as a ceiling needs to be painted. In such scenario, the painter may need to carry the paint container with him on a ladder to avoid the need of going back and forth the paint container and the ladder to refill the paintbrush. Though the method of carrying the paint container minimizes the strain and the time consumed in going back and forth, it does not address the repetitive process of dipping the paintbrush and applying the paint. Moreover, carrying an open paint container while painting the ceiling can cause accident and/or paint spillage. Furthermore, an open paint container allows emissions from the paint to enter the environment, contributing to pollution. As such it would be useful to have an improved system and method for loading paint continuously to a paintbrush.

SUMMARY

An improved system and method for loading paint continuously to a paintbrush is described herein. In one embodiment, a substantially cylindrical container can comprise a first orifice, a second orifice, a void, a plunger, a rod, a biasing device, and a paint-dispenser. The first orifice at a front end of the container, the first orifice can mount a nozzle. The second orifice at a back end of the container. The void that can be within the container can be fillable with the paint. The plunger can comprise a ring and the plunger can be tightly fitted within the void. The rod can be slidably mounted within the second orifice and the ring, wherein the front end of the rod can be positionable within the void. The biasing device can be mounted to the rod such that the biasing device can be placed in between the bottom end and the plunger. The biasing device can be positionable into expanded state, and extracted state. The expanded state wherein the void is not filled with the paint. The retracted state wherein the void is filled with the paint. Further, wherein the biasing device can move relatively to the amount of paint that can placed within the void. The paint-dispenser can be connectable with the container through a hose, the paint dispenser can comprise a button. The button once actuated can be capable of releasing the paint to a paintbrush bristles.

A method for loading paint continuously to a paintbrush is described herein. The method can comprise the steps of opening a cylindrical container, filling the void with the paint, attaching the paint-dispenser to the paintbrush, and applying the paint to a surface through actuating the button. The container can comprise a first orifice, a second orifice, a void, a plunger, a rod, a biasing device, and a paint-dispenser. The first orifice can be at a front end of the container. The first orifice can mount a nozzle. The second orifice can be at a back end of the container. The void that can be within the container can be fillable with the paint. The plunger can comprise a ring and the plunger can be tightly fitted within the void. The rod can be slidably mounted within the second orifice and the ring. The front end of the rod can be positionable within the void. The biasing device can be mounted to the rod such that the biasing device can be placed in between the bottom end and the plunger. The biasing device can be positionable into expanded state, and extracted state. The expanded state wherein the void can not be filled with the paint. The retracted state wherein the void can be filled with the paint. Further, wherein the biasing device can move relatively to the amount of paint that is placed within the void. The paint-dispenser can be connectable with the container through a hose. The paint dispenser can comprise a button. The button once actuated can be capable of releasing the paint to a paintbrush bristles.

DETAILED DESCRIPTION

Described herein is a system and method for loading paint continuously to a paintbrush. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
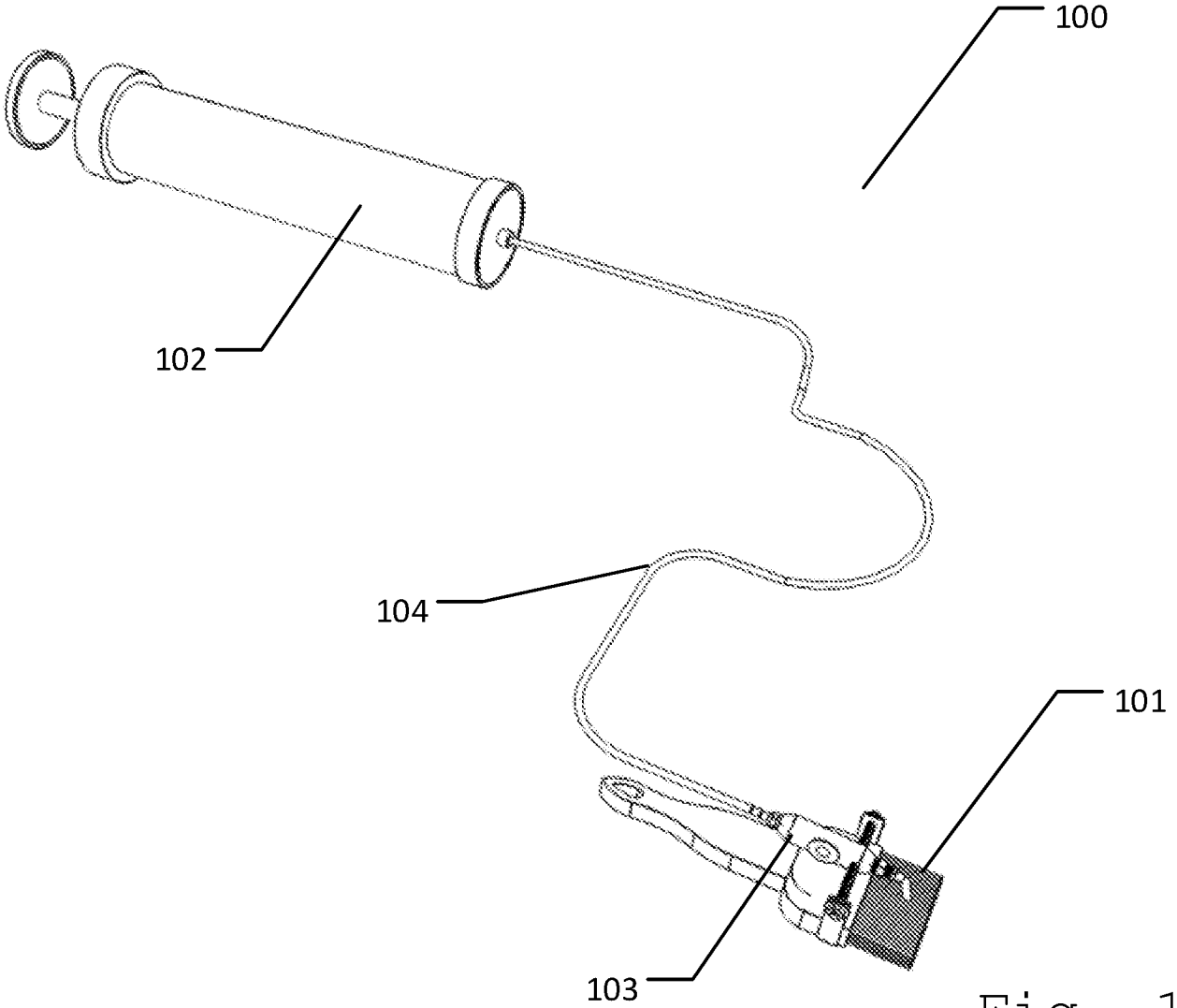
FIG. 1 illustrates a paint dispensing system attached to a paintbrush.

FIG. 1 illustrates a paint dispensing system 100 attached to a paintbrush 101. For purposes of this disclosure, paintbrush 101 can be any standard paintbrush that is used to apply paint. Paintbrush 101 can be in various shapes, kinds, and/or sizes. Paint dispensing system 100 can comprise a substantially cylindrical container 102, a paint dispenser 103, and a hose 104. Paint dispensing system 100 can be used to continuously load paint to paintbrush 101 to eliminate the need of frequently dipping paintbrush 101 onto a paint container. Container 102 can store and transfer paint from container 102 to paint-dispenser 103 through hose 104. Paint-dispenser 103 can be used to apply paint on a surface. In one embodiment, paint-dispenser 103 can be mountable to paintbrush 101. In this embodiment, paint-dispenser 103 can be attached together with paintbrush 101, as shown in FIG. 1. In another embodiment, paint-dispenser 103 and paintbrush can be a single device. In such embodiment, the outer end portion of paint-dispenser 103 can be mateable with a replaceable paintbrush head, as further discussed below. Hose 104 can be a flexible tube that connects container 102 and paint-dispenser 103. In one embodiment, each end of hose 104 can be permanently attached to container 102 and paint-dispenser 103. In some embodiments, each end of hose 104 can be removable from container 102 and paint-dispenser 103.

Figure 2:
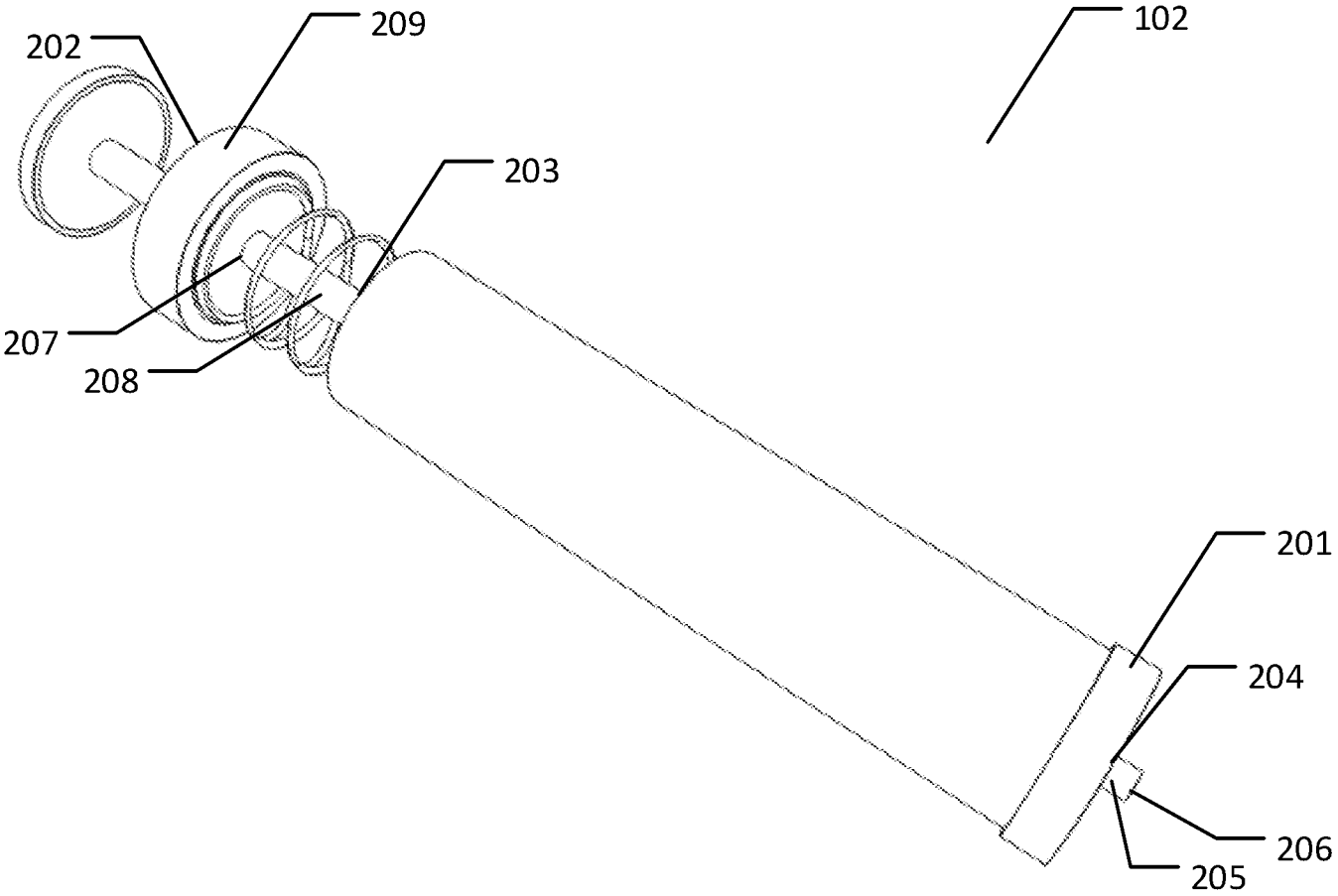
FIG. 2 illustrates a cylindrical container comprising a top end, a bottom end and a void.

FIG. 2 illustrates cylindrical container 102 comprising a top end 201, a bottom end 202, and a void 203. Top end 201 can be one end of container 102 that can comprise a first orifice 204. First orifice 204 can be a hole at the center of top end 201. Moreover, a nozzle 205 can be mounted to first orifice 204. In one embodiment, nozzle 205 can comprise a valve capable of directing and/or controlling the flow of paint within container 102. Nozzle 205 can comprise a nozzle hole 206 capable of discharging paint. Additionally, nozzle 205 can be mateable to one end of hose 104. In an embodiment wherein hose 104 can be removable from container 102, nozzle 205 can be a valve that can be closed when hose 104 is not connected. Thus, attaching one end of hose 104 to nozzle 205 can cause nozzle 205 to open. Bottom end 202 can be the other end of container 102 that can comprise a second orifice 207. Second orifice 207 can be a hole placed at the center of bottom end 202. Additionally, second orifice 207 can be insertable by a rod 208. Rod 208 can be a T-shaped bar that sticks out of bottom end 202. Void 203 can be the space within container 102. In one embodiment, at least one end of container 102 can comprise a removable lid 209. Removable lid 209 can allow void 203 be accessible and fillable with paint. Furthermore, removable lid 209 can be a cover capable of securely sealing container 102 to prevent spillage of paint. In such embodiment, one end of container 102 can comprise removable lid 209 while the other end of container 102 can be permanently sealed. In another embodiment, both top end 201 and bottom end 202 can be removable lids 209. Thus in such embodiment, void 203 can be accessible on either ends of container 102.

Figure 3:
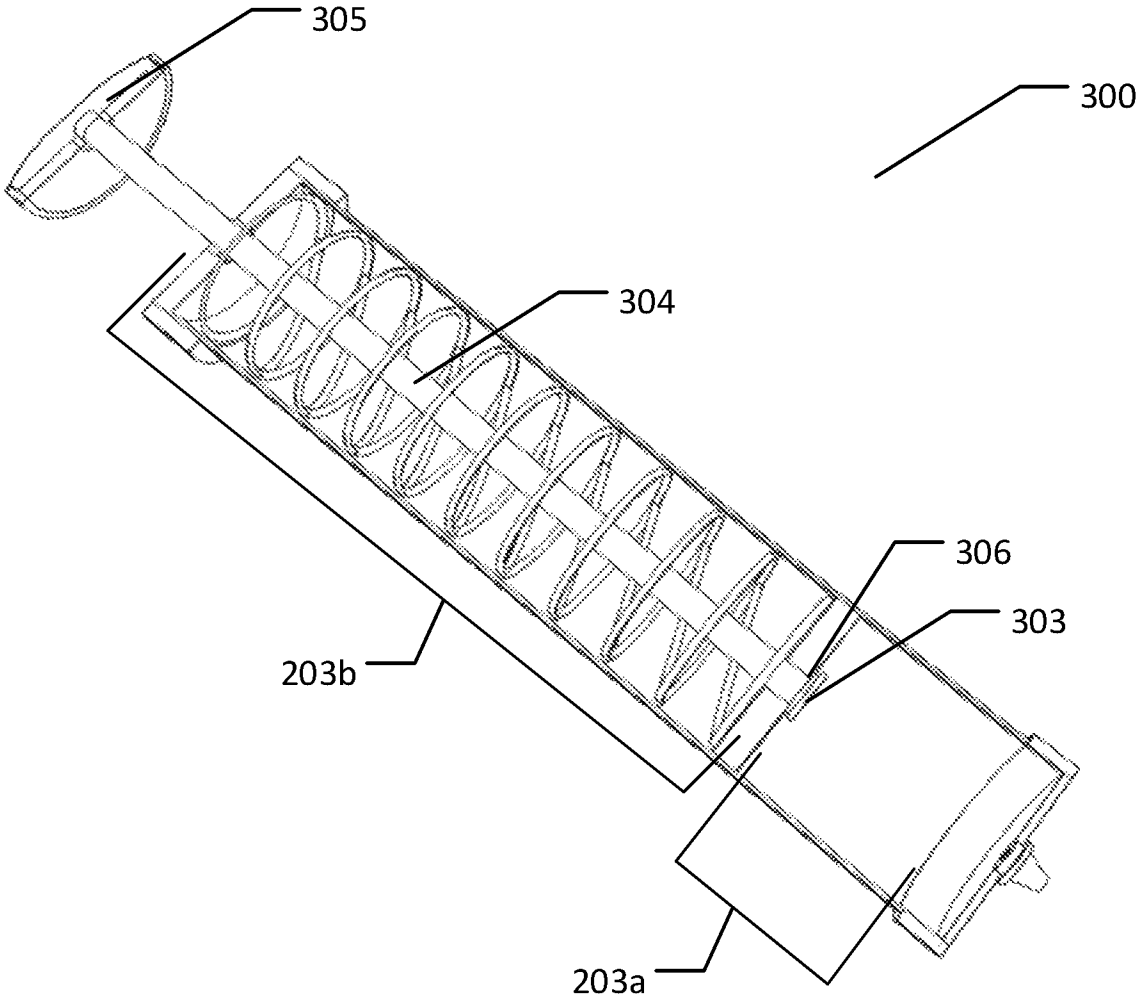
FIG. 3 illustrates a sectional view of a container comprising a plunger assembly.

FIG. 3 illustrates a sectional view of container 102 comprising a plunger assembly 300. Plunger assembly 300 can comprise rod 208, a plunger 301, and a biasing device 302. Rod 208 can comprise a cap 303, a shaft 304, and a handle 305. Cap 303 can be placed at the front-end portion of rod 208. Cap 303 can be the portion that comes in contact with top end 201. Cap 303 can be larger than shaft 304. In one embodiment, cap 303 can be permanently attached at the front end of rod 208. In such embodiment, cap 303 and shaft 304 can be a single device. As such cap 303 and shaft 304 can be permanently attached together through methods that can include but is not limited to molding, cementing, and/or adhesion. In another embodiment, cap 303 can be attachable at the front end of rod 208. In such embodiment, rod 208 can comprise a mateable portion that can be compatible with cap 303. Cap 303 can be any type of fastener that is compatible with the front end of rod 208. As an example, fasteners can comprise but is not limited to screws, washers, nuts, and bolts. Shaft 304 can connect cap 303 with handle 305. Handle 305 can be a bar perpendicularly placed at the bottom of shaft 304. Plunger 301 can be a disc-shaped device that fits tightly within container 102. The center of plunger 301 can comprise a ring 306. Furthermore, plunger 301 can divide void 203 into two parts, a first void 203*a* and a second void 203*b*. First void 203*a* can be the empty space created in between top end 201 and plunger 301. First void 203*a* can be used to contain paint. Second void 203*b* can be the space created in between plunger 301 and bottom end 202. Biasing device 302 can be placed within second void 203*b*. In one embodiment, biasing device 302 can be a spring. As such, biasing device 302 can be capable of expanding and/or retracting relative to the amount of liquid contained within first void 203*a*. As an example shown in FIG. 3, biasing device 302 can be at an expanded state when first void 203*a* is empty.

Further, rod 208 can connect plunger 301, biasing device 302, and bottom end 202 together. In such structure, second orifice 207 and ring 306 can be large enough to allow shaft 304 to slide through bottom end 202 and plunger 301. Plunger 301 can be placed parallel and in between top end 201 and bottom end 202. Cap 303 can be placed at the outer surface of plunger 301. Moreover, cap 303 can be larger than ring 306 that can prevent plunger 301 from slipping out of rod 208. Additionally, cap 303 can be larger than first orifice 204, which can prevent rod 208 from slipping out of first orifice 204. In some embodiment, since rod 208 can be slidable within container 102, cap 303 can be pushed towards front end 201 to prevent paint from passing through first orifice 204. In such embodiment, by pulling rod 208 through handle 305 first orifice 204 can be unblocked by cap 303 thus allowing paint to pass through. Biasing device 302 can then be mounted onto shaft 304. The inner surface of plunger 301 that faces bottom end 202 can come in contact with one end of biasing device 302, while the other end of biasing device 302 can be in contact with the inner surface of bottom end 202. Bottom end 202 can prevent biasing device 302 from slipping out of container 102. Handle 305 can stick out of second orifice 207. Furthermore, handle 305 can prevent rod 208 from passing through void 203.

Figure 4A:
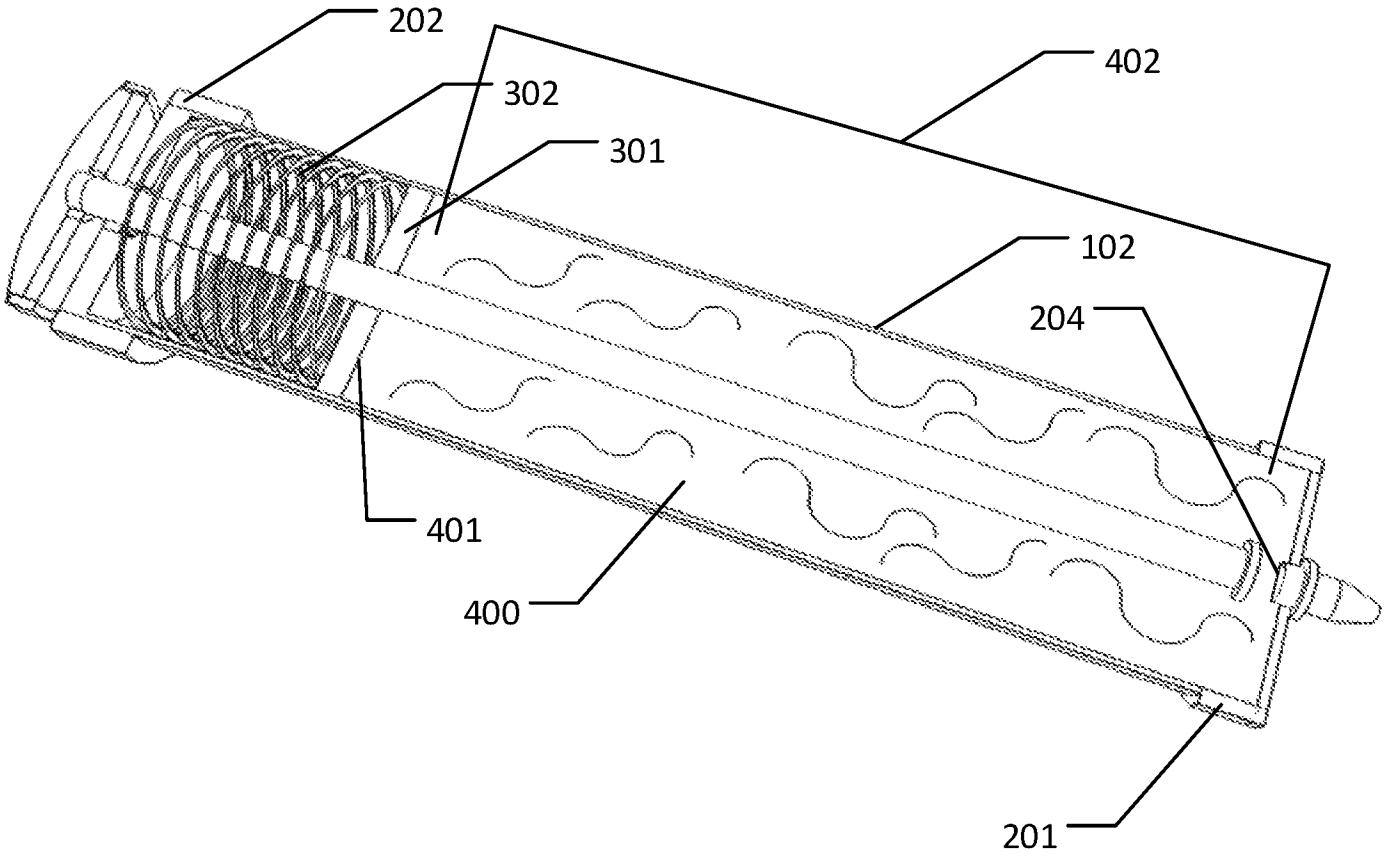
FIG. 4A illustrates a sectional view of a container filled with paint at a maximum fill capacity.

FIG. 4A illustrates a sectional view of container 102 filled with paint 400 at a maximum fill capacity 401. Maximum fill capacity 401 can be the maximum amount of fluid that container 102 can accommodate. Maximum fill capacity 401 can be relative to the maximum compressed state capacity of biasing device 302, as shown in FIG. 4A. As such, a space 402 created when biasing device 302 can be at maximum compressed state can be equals to maximum fill capacity 401 of container 102. In such state, plunger 301 can rest at the top surface of paint 400 that can in turn push and allow biasing device 302 to fully retract towards bottom end 202. The process of filling in container 102 with paint 400 can cause pressure within void 203.

Figure 4B:
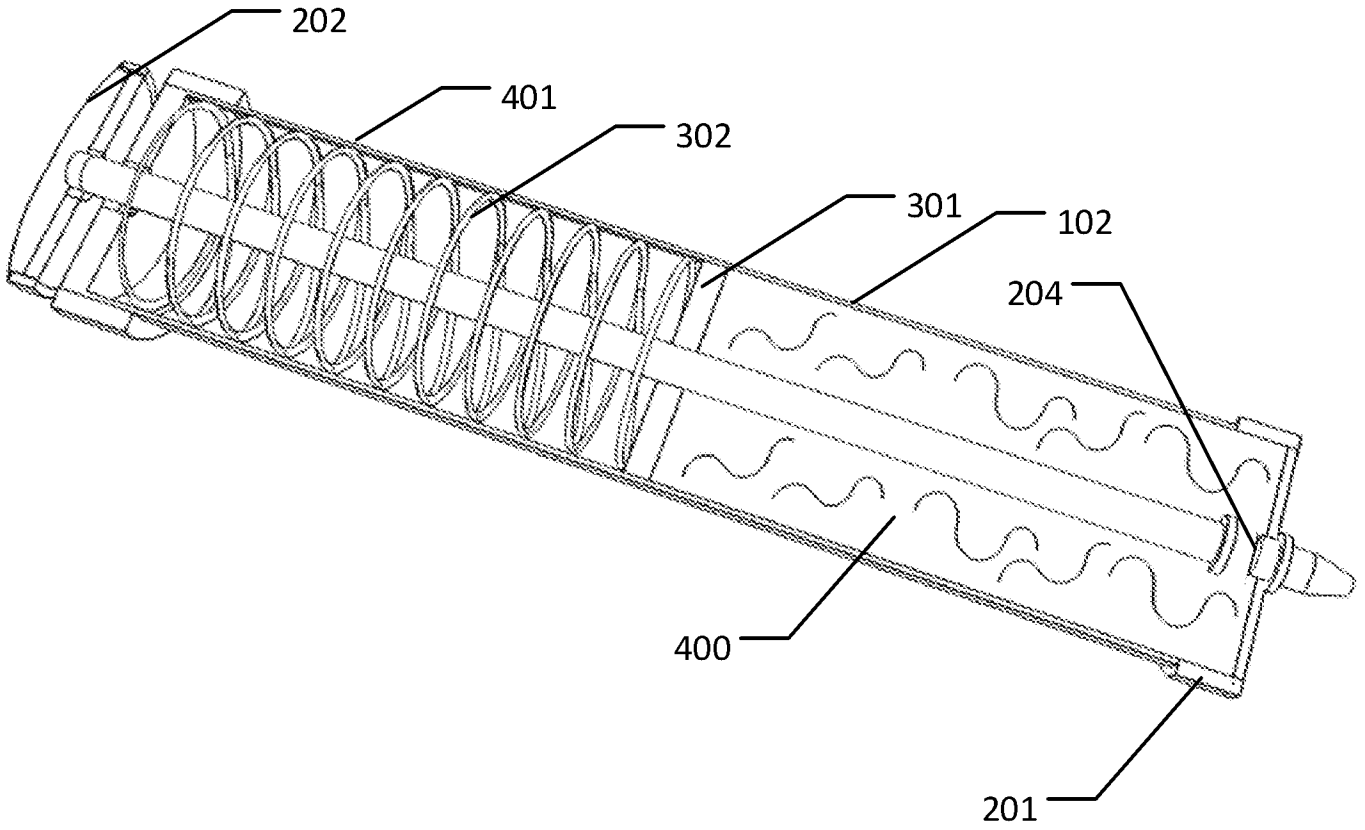
FIG. 4B illustrates another sectional view of a container filled with paint.

FIG. 4B illustrates another sectional view of container 102 filled with paint 400. In this embodiment, paint 400 within first void 203*a* can be below maximum fill capacity 401. In such example, plunger 301 can rest at the top surface of paint 400 which can push and partially retract biasing device 302 towards bottom end 202.

Figure 5:
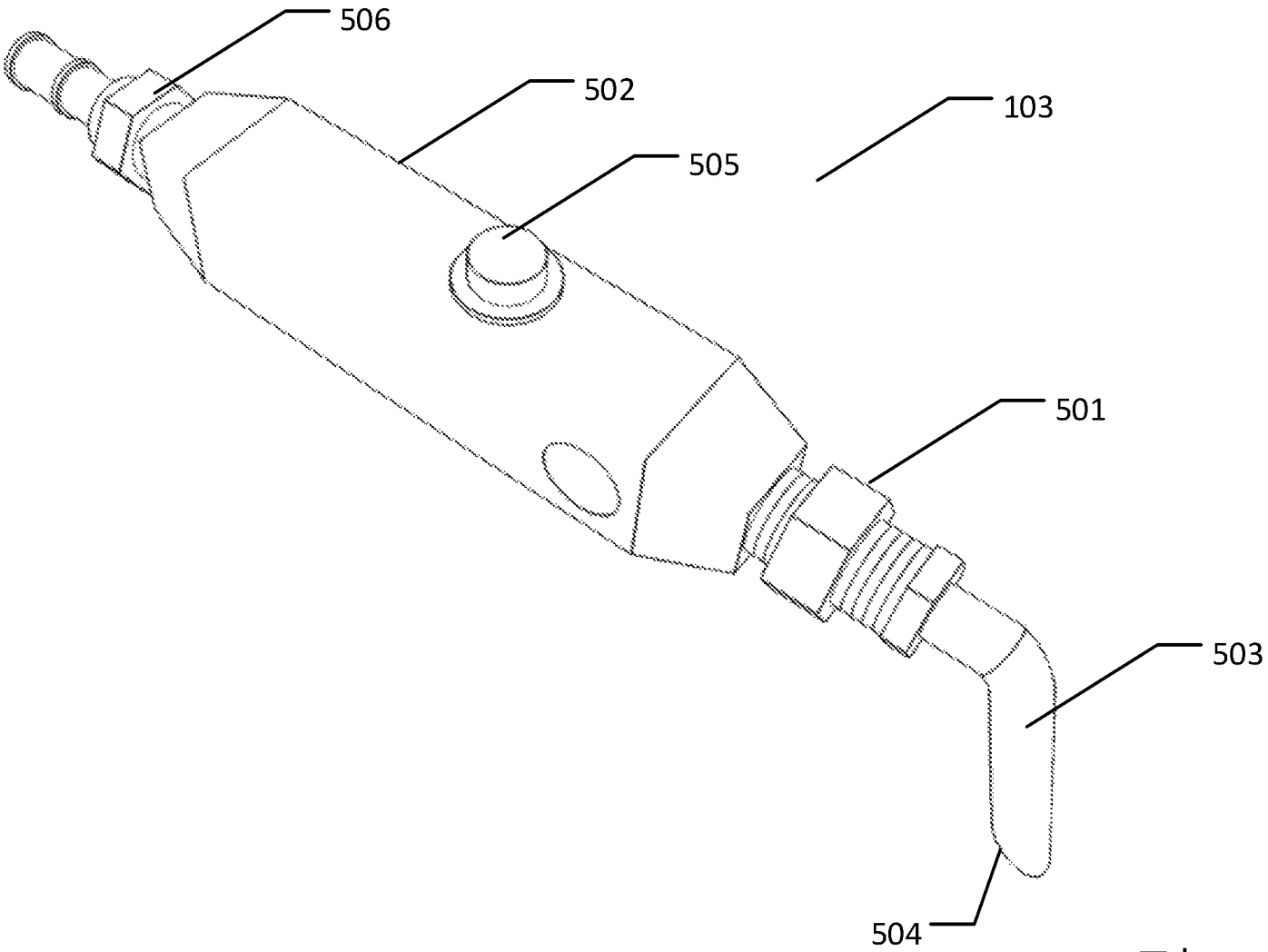
FIG. 5 illustrates a paint-dispenser comprising a head, a body.

FIG. 5 illustrates paint-dispenser 103 comprising a head 501, and a body 502. Head 501 can be the frontend section of paint-dispenser 103. Head 501 can comprise a paint tube 503. Paint tube 503 can be the thin tubing placed at the outer end portion of head 501. In one embodiment, paint tube 503 can be bent in shape. In some embodiments, paint tube 503 can comprise of durable and flexible material such as plastic. Paint tube 503 can comprise an opening 504. Opening 504 can be the portion where paint 400 is dispensed. Body 502 can be the section that holds the parts of paint-dispenser 103. Body 502 can comprise a button 505. Button 505 can be used to control the flow of paint 400. As such, pressing button 505 can stop and/or end the flow of paint 400 on paint-dispenser 103. In one embodiment, paint dispenser 103 can comprise a valve 506 at the rear end portion of body 502. In an embodiment wherein hose 104 can be removable, valve 506 can also comprise a threaded portion mateable with hose 104.

Figure 6A:
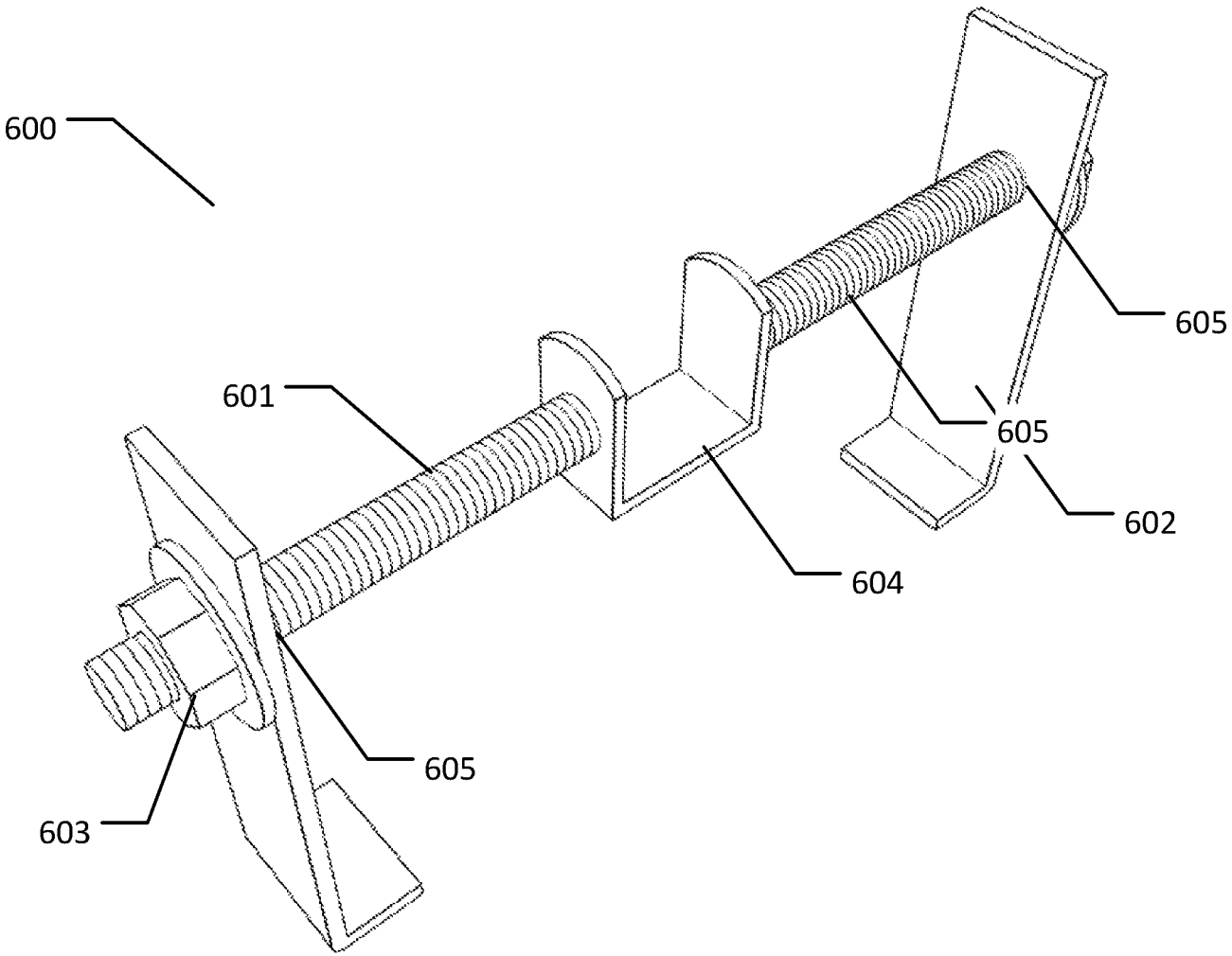
FIG. 6A illustrates a paint-dispenser mounted to a fastening device.

FIG. 6A illustrates paint-dispenser 103 mounted to a fastening device 600. Fastening device 600 can securely attach paint-dispenser 103 and paintbrush 101 together. In one embodiment, fastening device 600 can comprise a threaded pole 601, a pair of grips 602, and a pair of fasteners 603. Threaded pole 601 can be a long threaded shaft that can comprise a paint-dispenser holder 604. Paint-dispenser holder 604 can be attached at the middle portion of threaded pole 601. In one embodiment, paint-dispenser holder 604 can be a clamp that can wrap onto the side edges of paint-dispenser 103. Each grip 602 can be an L-shaped plate placed at the opposite side of fastening device 600. Each grip 602 can comprise a plate hole 605, and a leg 606. Plate hole 605 can be large enough to accommodate each opposite end of threaded pole 601. Leg 606 can be the extended portion at the bottom of grip 602. Fasteners 603 can be mateable at both ends of threaded pole 601. Fasteners 603 can include but is not limited to washers, nuts, and bolts.

Figure 6B:
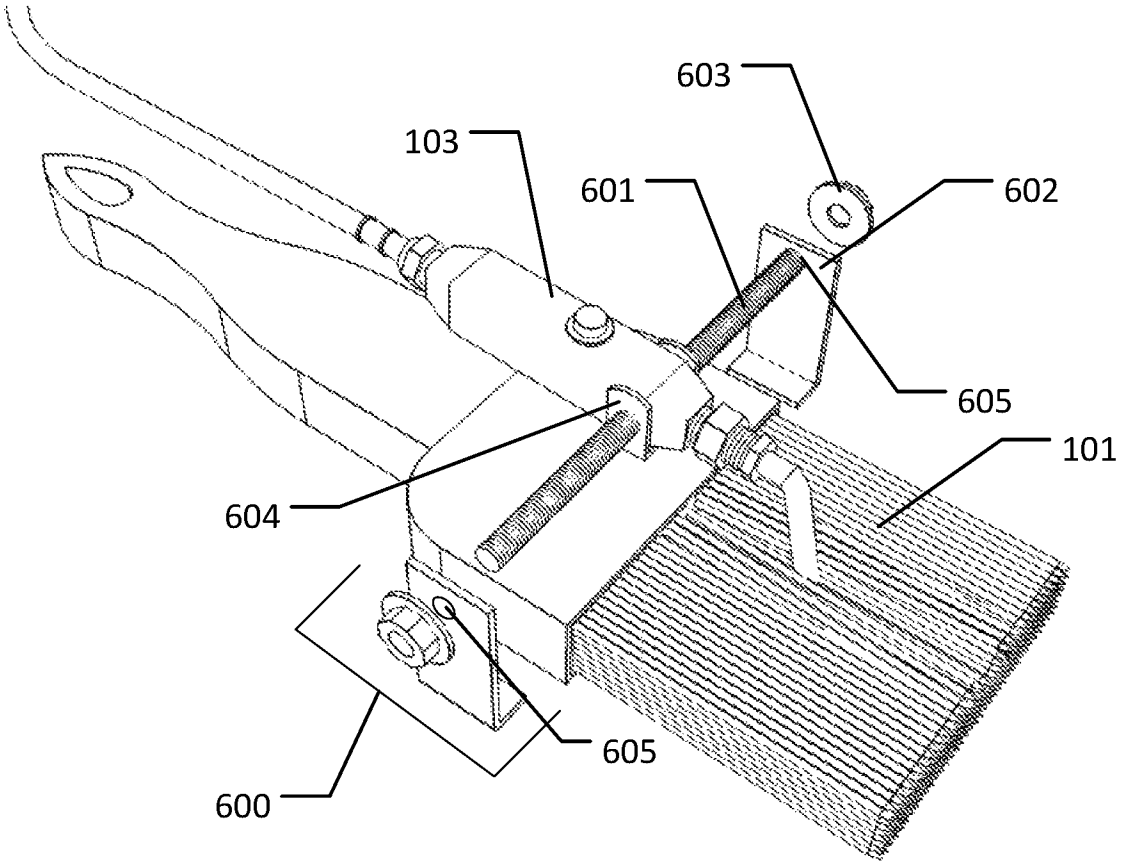
FIG. 6B illustrates how a fastening device can attach a paint-dispenser to a paintbrush.

FIG. 6B illustrates how fastening device 600 can attach paint-dispenser 103 to paintbrush 101. First, paint-dispenser 103 can be mounted onto paint-dispenser holder 604. Then, threaded pole 601 can be positioned above the topside surface of paintbrush 101 such that opening 504 can be placed within the bristles of paintbrush 101. The bent shape of paint tube 503 can allow opening 504 be positionable within the bristles of paintbrush 101. Once in position, each of the opposite ends of threaded pole 601 can be inserted to plate hole 605 of each grip 602. Grip 602 can then be attached onto threaded pole 601 such that leg 606 of each grip 602 faces inwardly and are placed below the bottom side surface of paintbrush 101. Finally, each fastener 603 can be mated at each end of threaded pole 601. In such structure, as fasteners 603 are threaded onto threaded pole 601 grips 602 can clasp at the opposite sides of paintbrush 101 thus securely attaching paintbrush 101 and paint-dispenser 103 together. Furthermore, such structure can allow different sizes of paintbrush 101 be attachable with paint-dispenser 103.

Figure 7A:
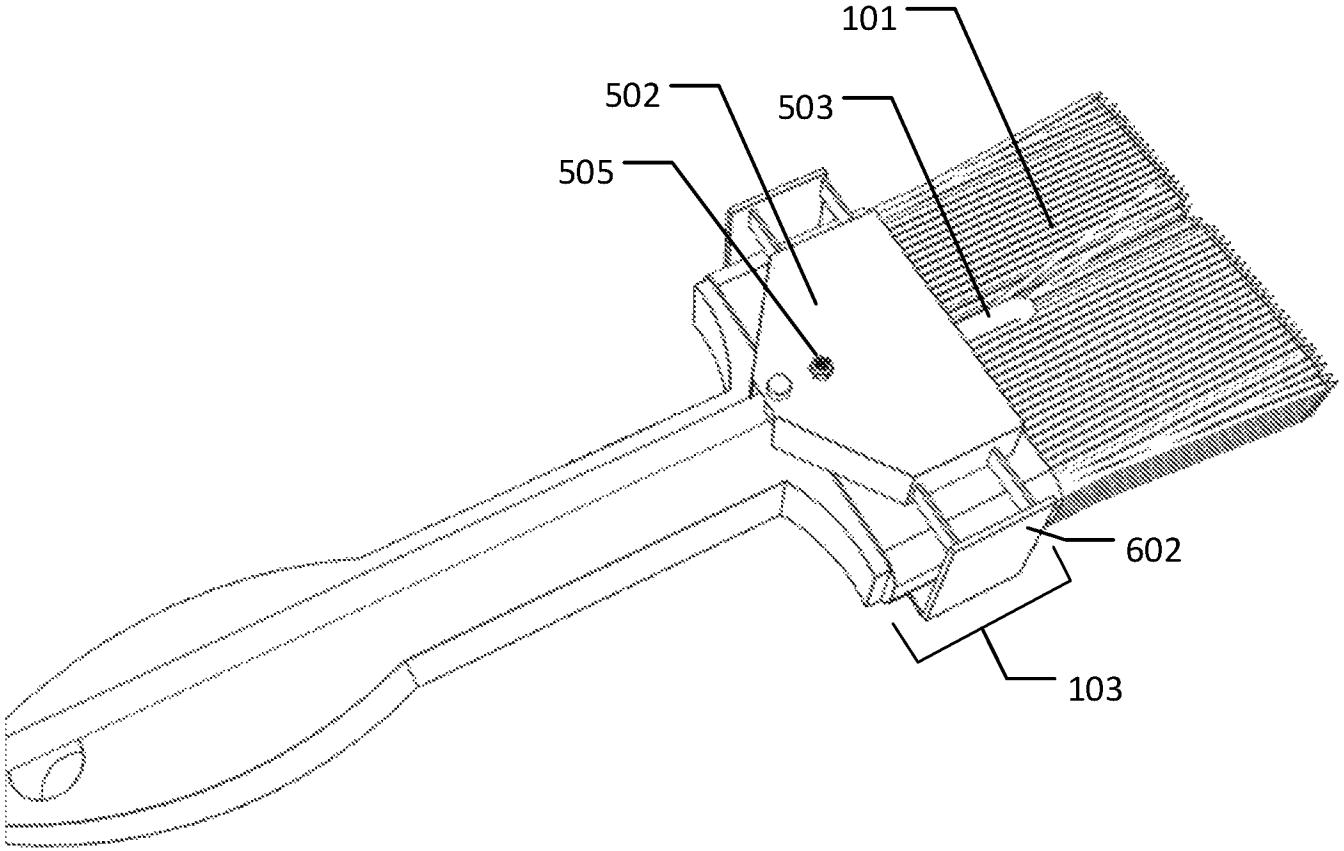
FIG. 7A illustrates a paint-dispenser attached to a fastening device.

FIG. 7A illustrates paint-dispenser 103 attached to fastening device 600. In such embodiment, paint-dispenser 103 and fastening device 600 can be unibody. As such, paint-dispenser 103 can attach to the body of paintbrush 101. In this embodiment, body 502 can comprise grips 602, button 505, and paint tube 503. Each L-shaped plate can be placed at the opposite sides of body 502. Grips 602 can be capable of clasping the opposite sides of paintbrush 101. Button 505 can be placed at the top surface of body 502. Paint tube 503 can be placed at the center frontend portion of body 502.

Figure 7B:
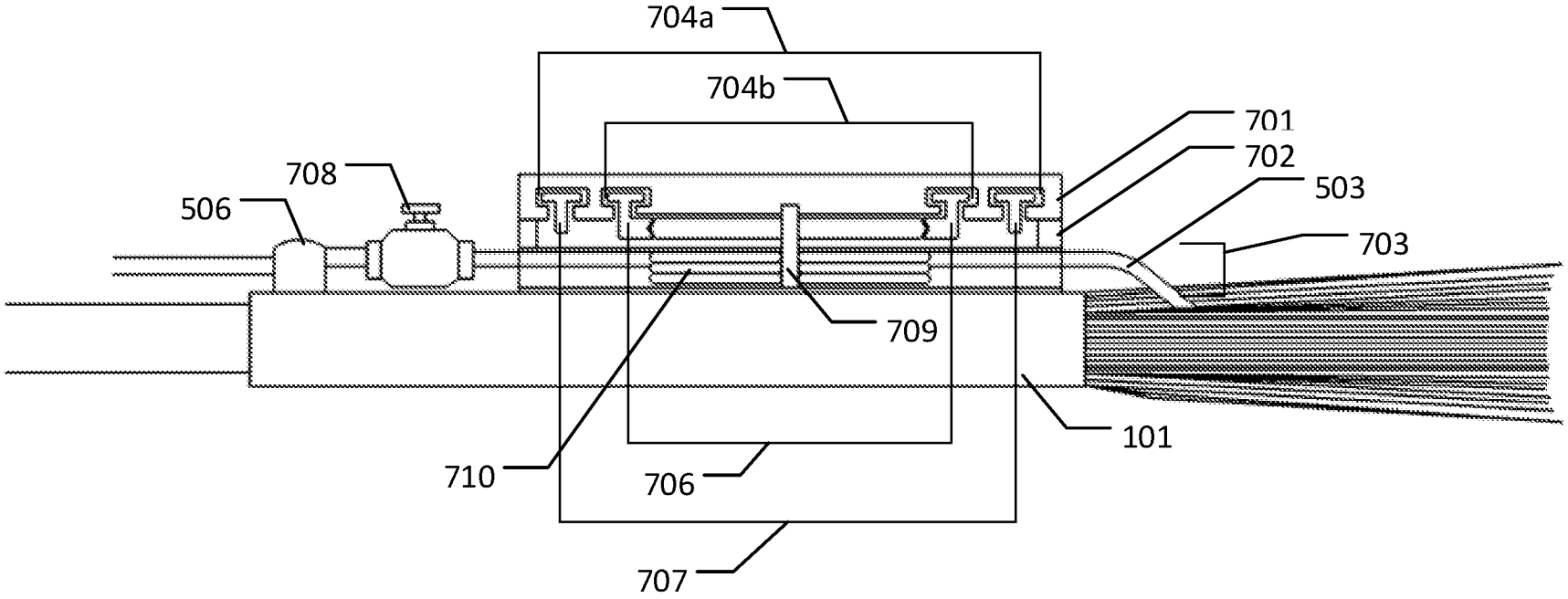
FIG. 7B illustrates a side-sectional view of a paint-dispenser.

FIG. 7B illustrates a side sectional view of paint-dispenser 103. In this embodiment, body 502 can comprise a top layer 701, a middle layer 702, and a bottom layer 703. Top layer 701 can comprise a pair of rail tracks 704*a*, and a pair of rack tracks 704*b*. Each rail track 704 can be a T-shaped opening within the inner surface of top layer 701. Middle layer 702 can be the inner surface of body 502. Middle layer 702 can be the section between top layer 701 and bottom layer 703. Moreover, Middle layer 702 can comprise a pair of rails 705, a pair of racks 706, a pair of pinions 707, and a flow control screw 708. Each rail 705 can be a T-shaped rail that is placed at the opposite sides of middle layer 702. The top portion of each rail 705 can be compatible with each rail tracks 704*a*. The top portion of each rack 706 can be in a T-shape form compatible with each rack track 704*b*. The bottom portion of each rack 706 can comprise a plurality of tooth that comes in contact with the outer edges of each pinion 707. Each pinion 707 can be placed in between racks 706. Furthermore, each pinion 707 can rotate around an axis. Flow control screw 708 can be placed at the bottom portion of body 502. Furthermore, flow control screw 708 can be positioned above paint tube 503. Moreover, flow control screw 708 can be positioned below button 505. In such structure, when button 505 is actuated flow control screw can push a portion of paint tube 503 controlling the amount of paint 400 that can pass through paint tube 503. Bottom layer 703 can comprise a pair of axes 709, and a pair of torsion spring 710. Each axis 709 can be centrally placed between racks 706. Further, each pinion 707 can be mounted at the top end portion of each axis 709 while each torsion spring 710 can be mounted at the bottom end portion of each axis 709. As such, each torsion spring 710 can be placed directly under each pinion 707. For purposes of this disclosure, only one of the components that comes in pair such as pinions 707, axes 709, and torsion springs 710 can be shown in FIG. 7B. These components will be further shown and discussed below.

Figure 7C:
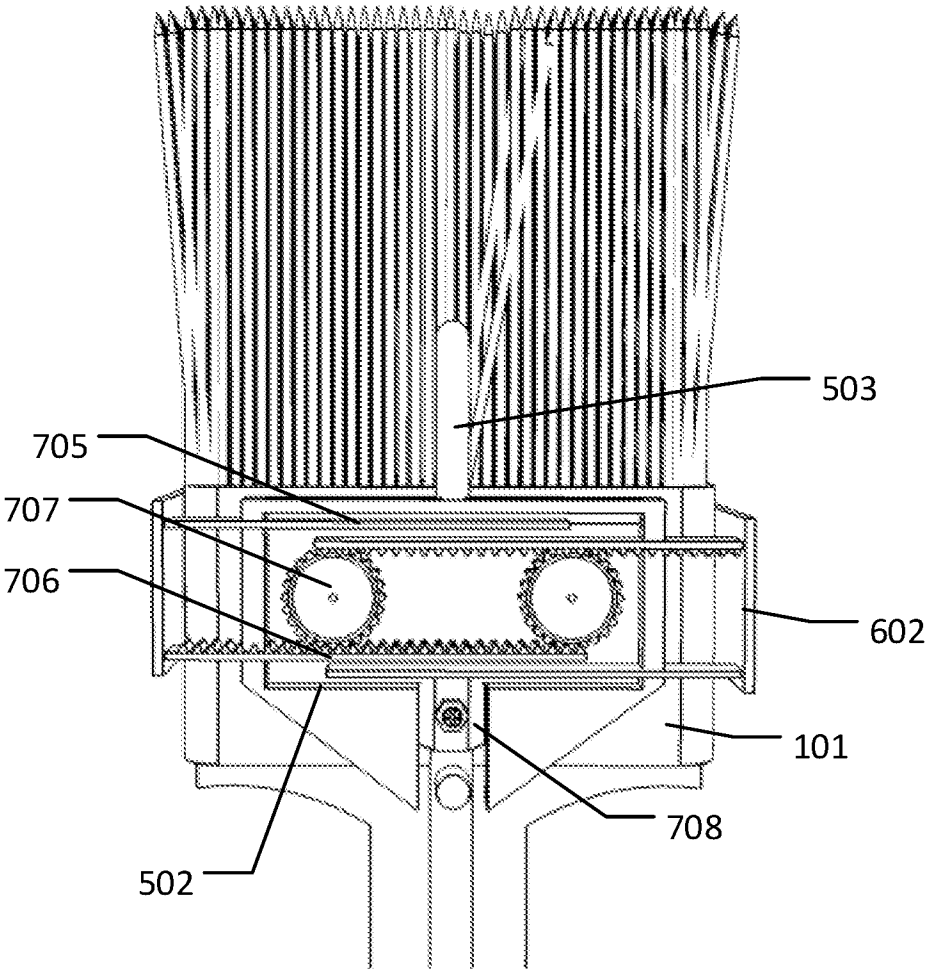
FIG. 7C illustrates a top sectional view of a paint-dispenser attached to a paintbrush.

FIG. 7C illustrates a top sectional view of paint-dispenser 103 attached to paintbrush 101. In this embodiment, one of said racks 706 and one of said rails 705 can be attached at the opposite side top portion of each grip 602, such that one of said racks 706 and one of said rails 705 are parallel to each other. Each grip 602 can be connected at the opposite sides of body 502. As such, rails 705 and racks 706 can alternately interlap each other. Grips 602, racks 706, and rails 705 connected together can create a rectangular space 711 at the center. In such structure, rails 705 can be positioned at the outer portion of rectangular space 711 while racks 706 can be at the inner portion of rectangular space 711. Each pinion 707 can be placed within rectangular space 711 and near the opposite sides of body 502. In this position, each rack 706 can be placed at the top and at the bottom of pinions 707, which can allow toothed portions of each rack 706 be meshed with the outer edge portions of pinions 707. Further as an example scenario, pulling one of grip 602 outwardly can cause both racks 706 to move outwards causing both pinions 707 to rotate in the same outwards direction. In this configuration, the expanded distance of the pull made on one of grip 602 can be equals to the expanded distance that is pushed out on the other grip 602. This can ensure that when paint-dispenser 103 is mounted to paintbrush 101, paint tube 503 can still be positioned at the center of the paintbrush regardless of the size of paintbrush 101.

Figure 7D:
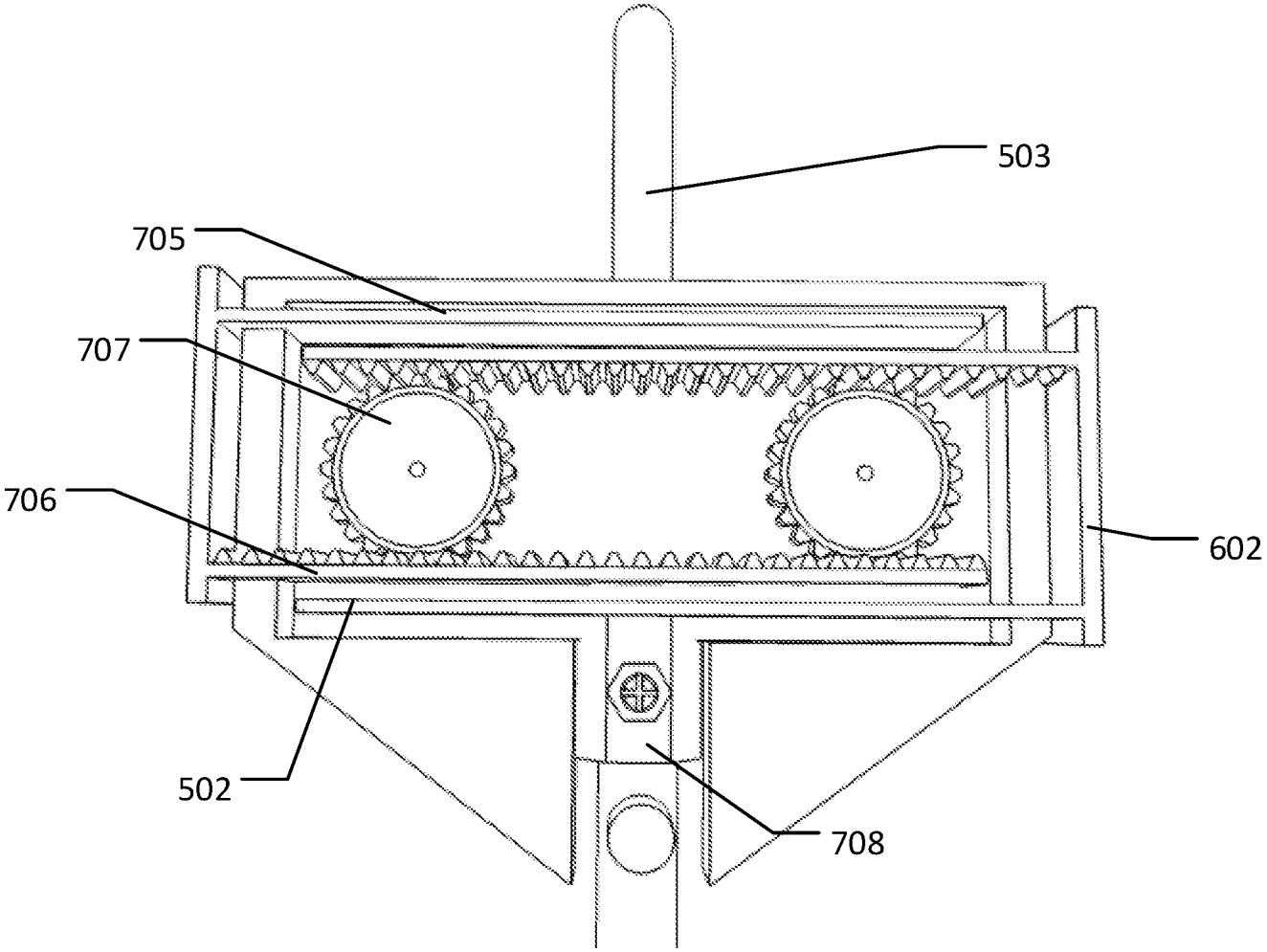
FIG. 7D illustrates a top sectional view of a paint-dispenser at a retracted state.

FIG. 7D illustrates top sectional view of paint-dispenser 103 at a retracted state. In such state, both grips 602 can rest at the opposite sides of body 502. Moreover, the length of each rails 705 and racks 706 can be equal to the interior width of body 502 such that when L-shaped plates are at a retracted state, rails 705 and racks 706 can fit snugly within body 502.

Figure 7E:
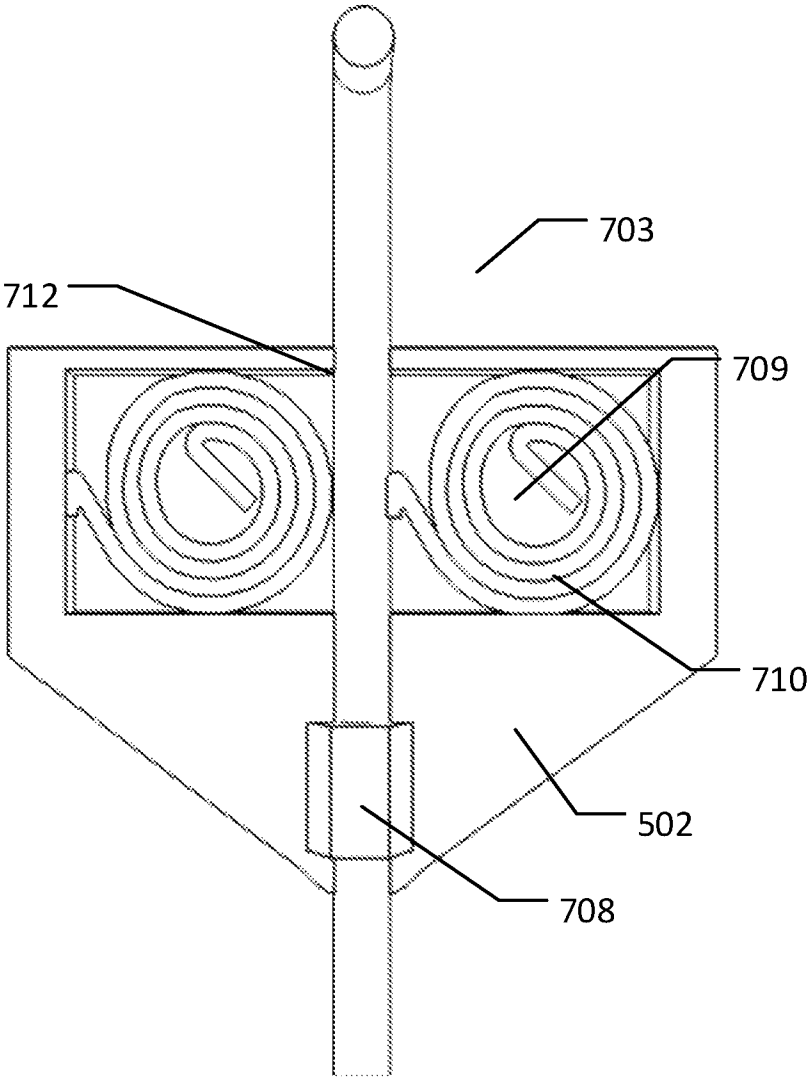
FIG. 7E illustrates a bottom layer a paint-dispenser.

FIG. 7E illustrates bottom layer 703 of paint-dispenser 103. Bottom layer 703 can comprise a pair of inner walls 712. Inner walls 712 can be placed at the center of bottom layer 703. Inner walls 712 can be wide enough to accommodate paint tube 503. Moreover, inner walls 712 can be in between torsion springs 710. Torsion springs 710 can be capable of biasing each grip 602 towards the center of body 502. As such, torsion springs 710 can allow grips 602 to securely wrap at the opposite sides of paintbrush 101. Each torsion spring 710 can be mounted to each axis 709. Additionally, each torsion spring 710 can be placed at the opposite sides of bottom layer 703. One end of each torsion spring 710 can be attached at the outer surface of inner walls 712, while the other end of each torsion spring 710 can be attached to each axis 709. In this structure, rotating axes 709 can also wind each torsion spring 710. Thus, when no force or motion is applied on axes 709, torsion spring 710 can spring back to its position that can pull grips 602 towards the center of body 502.

Figure 8A:
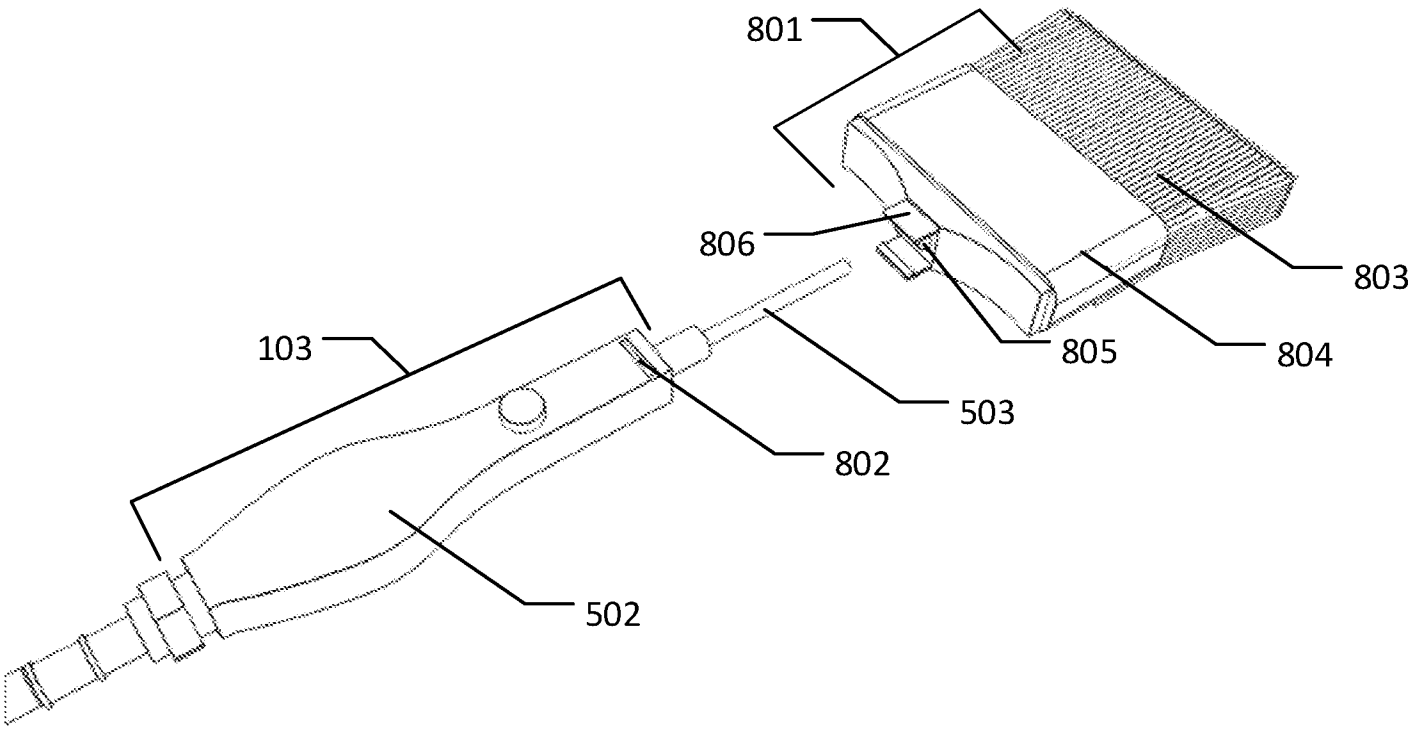
FIG. 8A illustrates an embodiment of a paint-dispenser comprising a replaceable paintbrush head.

FIG. 8A illustrates an embodiment of paint-dispenser 103 comprising a replaceable paintbrush head 801. Paintbrush head 801 can be in various shapes and/or sizes. In this embodiment, paint tube 503 can be straight narrow tubing that extends from the frontend section of body 502. Paint tube 503 can be insertable within replaceable paintbrush head 801. Further in one embodiment, paint-dispenser 103 can resemble the shape of a paintbrush handle. In such embodiment, the frontend portion of body 502 can comprise a pair of crevices 802. Crevices 802 can be small slots at the top and at the bottom surface of body 502. Further, replaceable paintbrush head 801 can comprise a plurality of bristles 803 and ferule 804. Bristles 803 can comprise of straight hair attached at the front end of ferule 804. Ferule 804 can be a bracket that holds bristles 803 together. Ferule 804 can comprise a socket 805. Socket 805 can be a narrow opening placed at the center of the rear end of ferule 804. Socket 805 can be large enough to accommodate body 502. Socket 805 can comprise a pair of locks 806. Locks 806 can be extended portions at the rear edge of ferule 804. Each lock 806 can be attached at the topside surface and at the bottom side surface of paintbrush 101. As such, locks 806 can extend outwards from rear end of ferule 804. Locks 806 can extend above and below socket 805. In one embodiment, locks 806 can be rocker clip fasteners.

Figure 8B:
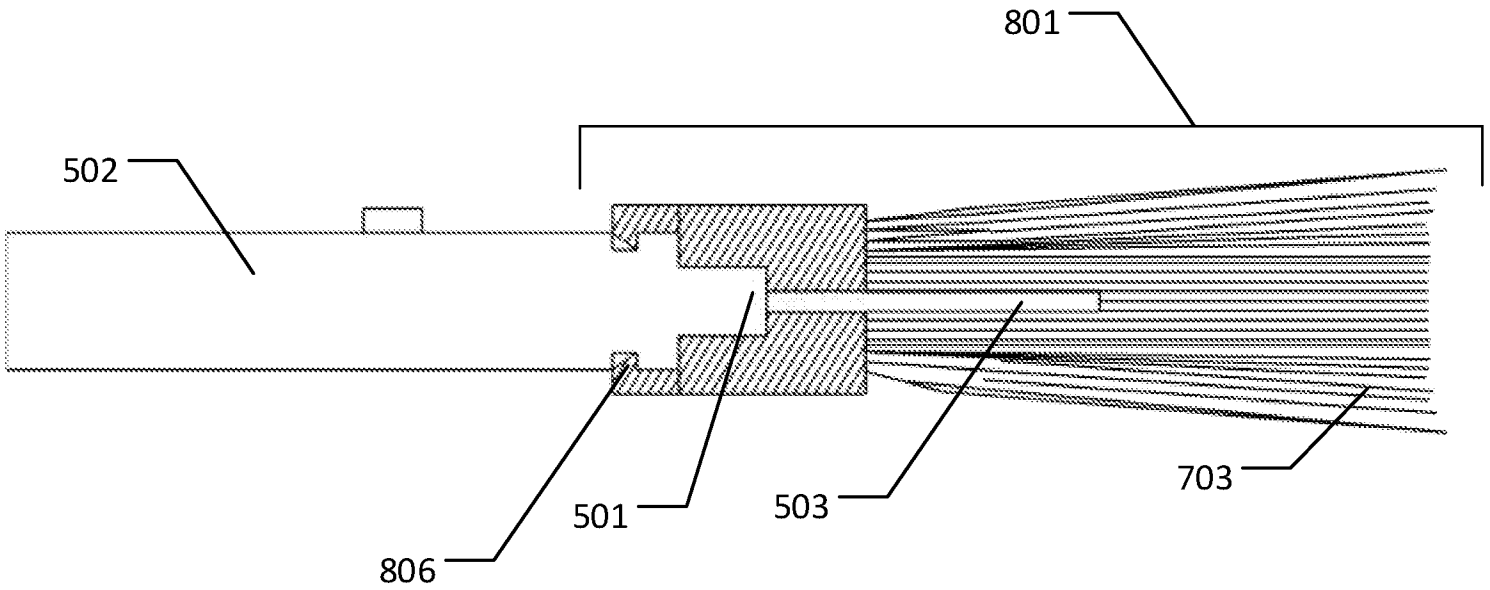
FIG. 8B illustrates a side sectional view of a paint-dispenser attached to a paintbrush head.

FIG. 8B illustrates a side sectional view of paint-dispenser 103 attached to paintbrush head 801. Frontend portion of body 502 can be inserted into socket 805 thus, placing head 501 within ferule 804, and positioning paint tube 503 within bristles 803. Locks 806 on paintbrush head 801 can be aligned and mated with crevices 802 of paint-dispenser 103. This can securely attach paintbrush head 801 and paint-dispenser 103 together.

Figure 9A:
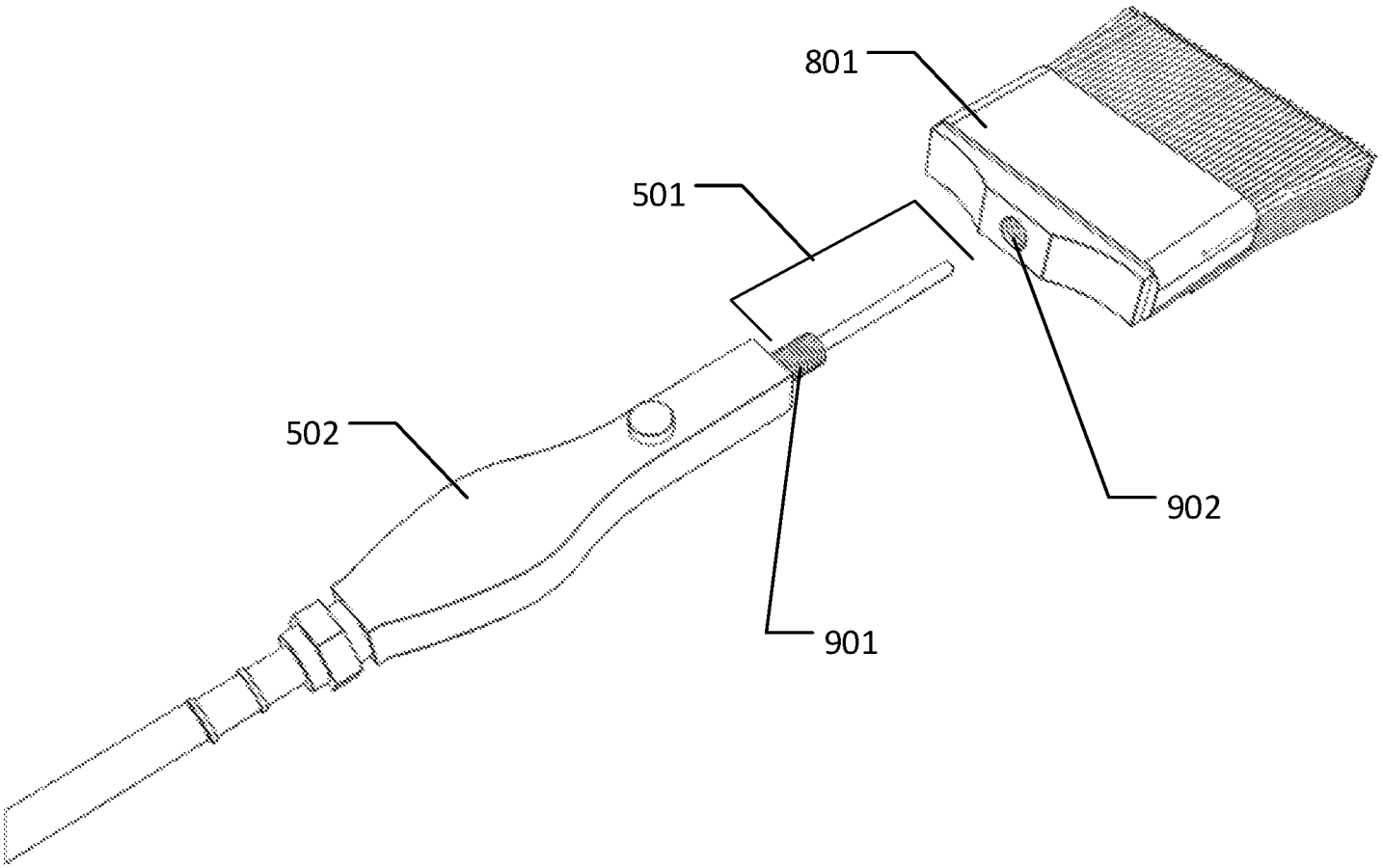
FIG. 9A illustrates another embodiment of a paint-dispenser.

FIG. 9A illustrates another embodiment of paint-dispenser 103. In this embodiment, head 501 can comprise a threaded portion 901 that can be mateable with a threaded socket 902. As such, the inner portion of threaded socket 902 can comprise threaded surface that can be compatible with threaded portion 901.

Figure 9B:
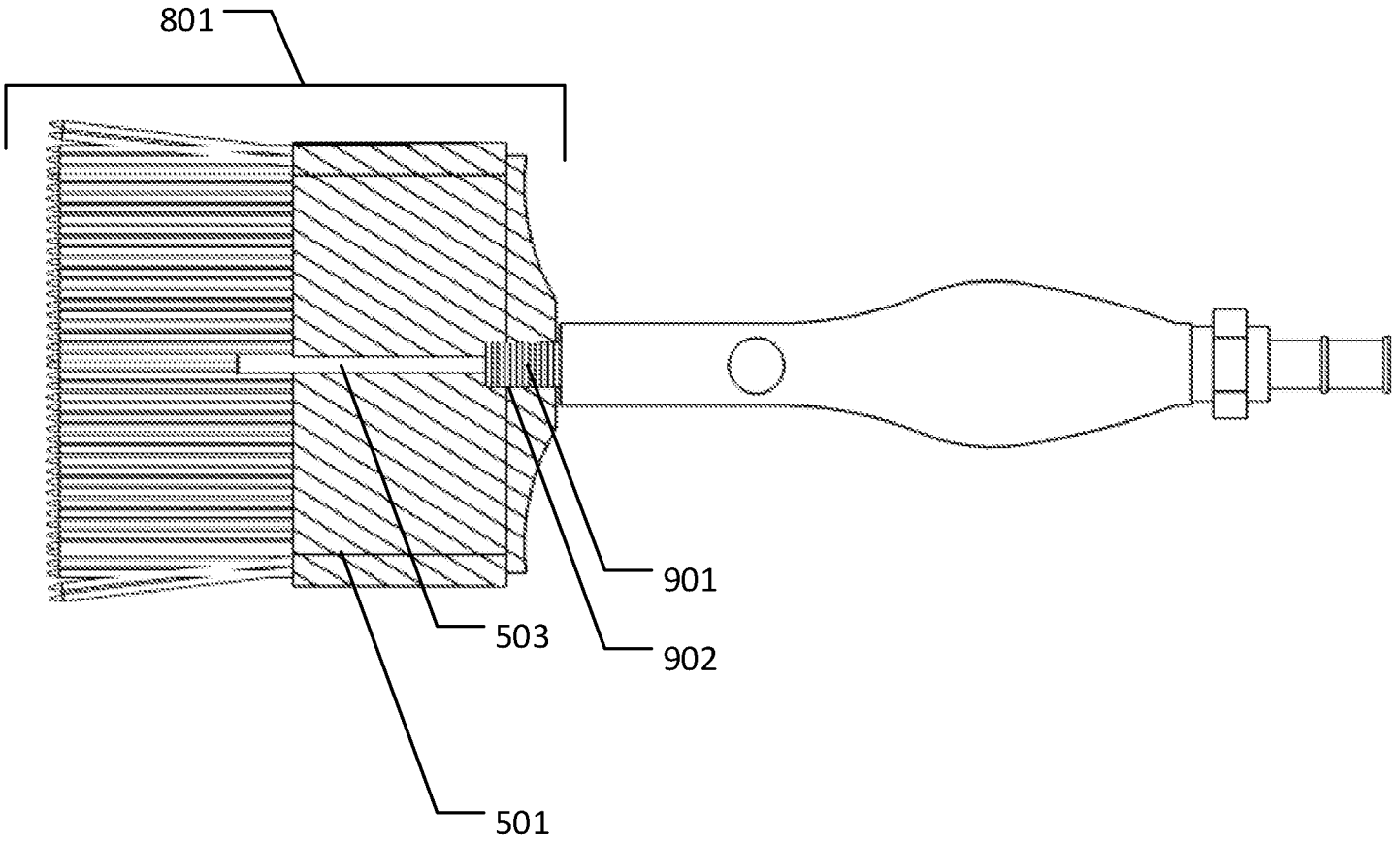
FIG. 9B illustrates a sectional view embodiment of a paint-dispenser.

FIG. 9B illustrates a sectional view embodiment of paint-dispenser 103. Head 501 can be inserted within threaded socket 902. Head 501 can be screwed within threaded socket 902 attaching paint-dispenser 103 and paintbrush head 801 together. Paint tube 503 can then be centrally positioned within bristles 803.

Figure 10:
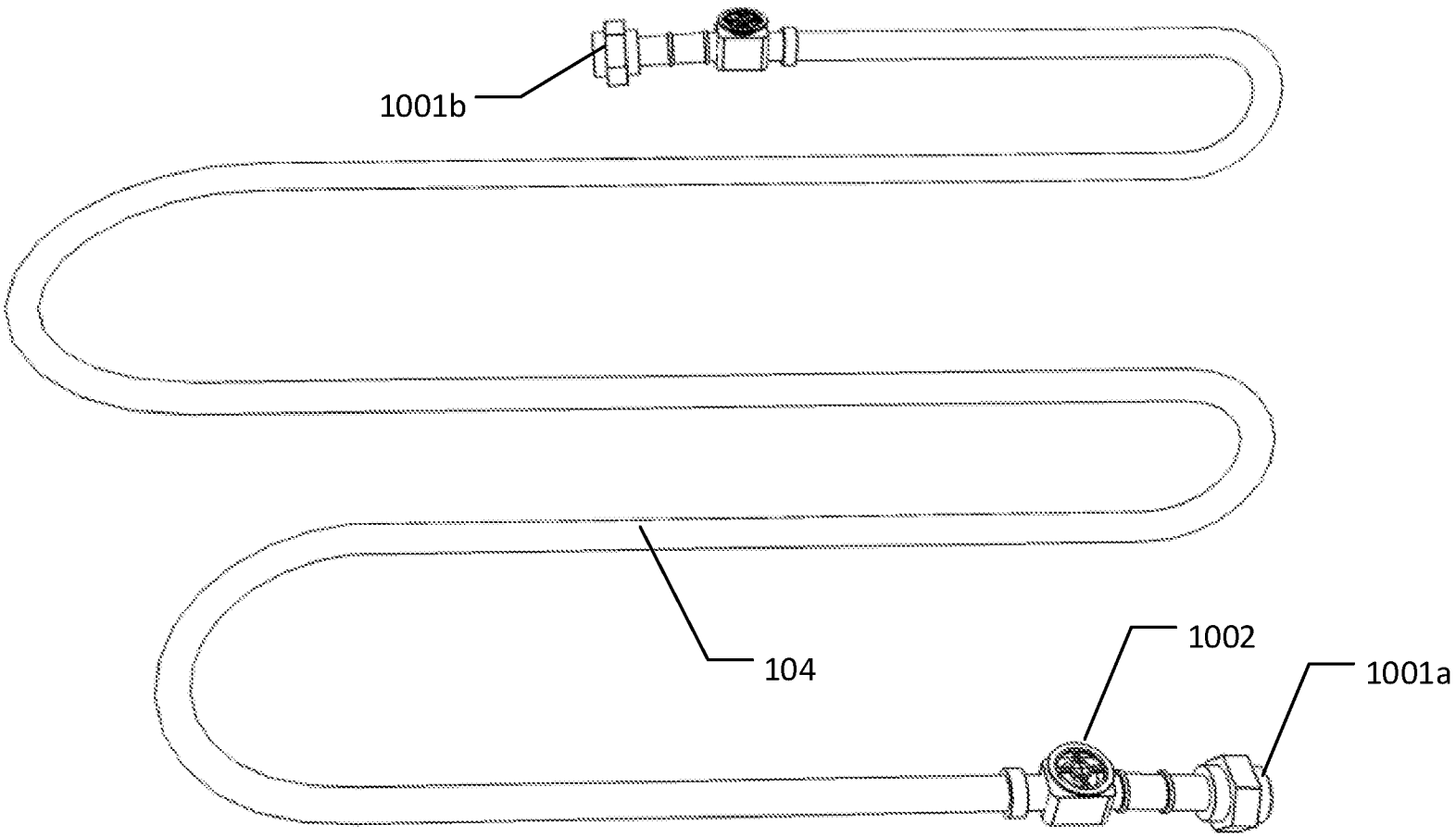
FIG. 10 illustrates a removable embodiment of a hose.

FIG. 10 illustrates a removable embodiment of hose 104. In this embodiment, hose 104 can comprise a pair of connectors 1001, and a pair of hose-valves 1002. Connectors 1001 can comprise a first connector 1001*a* and a second connector 1001*b*. First connector 1001*a* can be attachable with nozzle 205 of container 102, while second connector 1001*b* can be connectable at the rear end of paint-dispenser 103. Each hose-valve 1002 can be placed near the opposite ends of hose 104. Hose-valves 1002 can be used to stop and/or allow the flow of paint 400 from container 102 to paint-dispenser 103.

Figure 11:
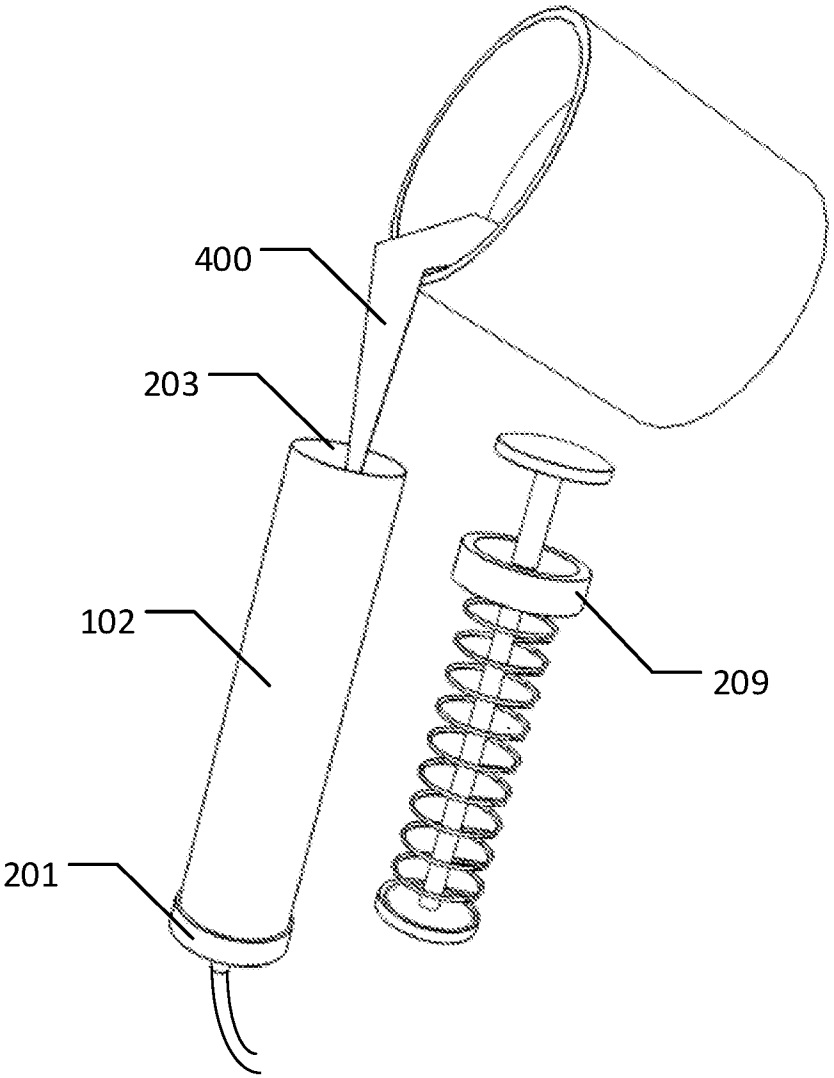
FIG. 11 illustrates how a container can be filled with paint.

FIG. 11 illustrates how container 102 can be filled with paint 400. To open container 102, removable lid 209 can be removed from one end of container 102. As an example embodiment, removable lid 209 that covers bottom end 202 can be taken off to provide access to void 203. In such embodiment, plunger assembly 300 can be removed from container 102. Once removed, paint 400 can be poured into container 102. After pouring paint 400 into container 102, removable lid 209 can be put back on. As such, plunger assembly 300 can be inserted within void 203, creating pressure within container 102. Further in an embodiment wherein hose 104 can be removable, hose 104 can first be connected to container 102 and paint-dispenser 103 after covering container 102 with removable lid 209. As such, first connector 1001*a* can be connected to nozzle 205 and second connector 1001*b* can be connected to valve 506 of paint-dispenser 103.

Figure 12:
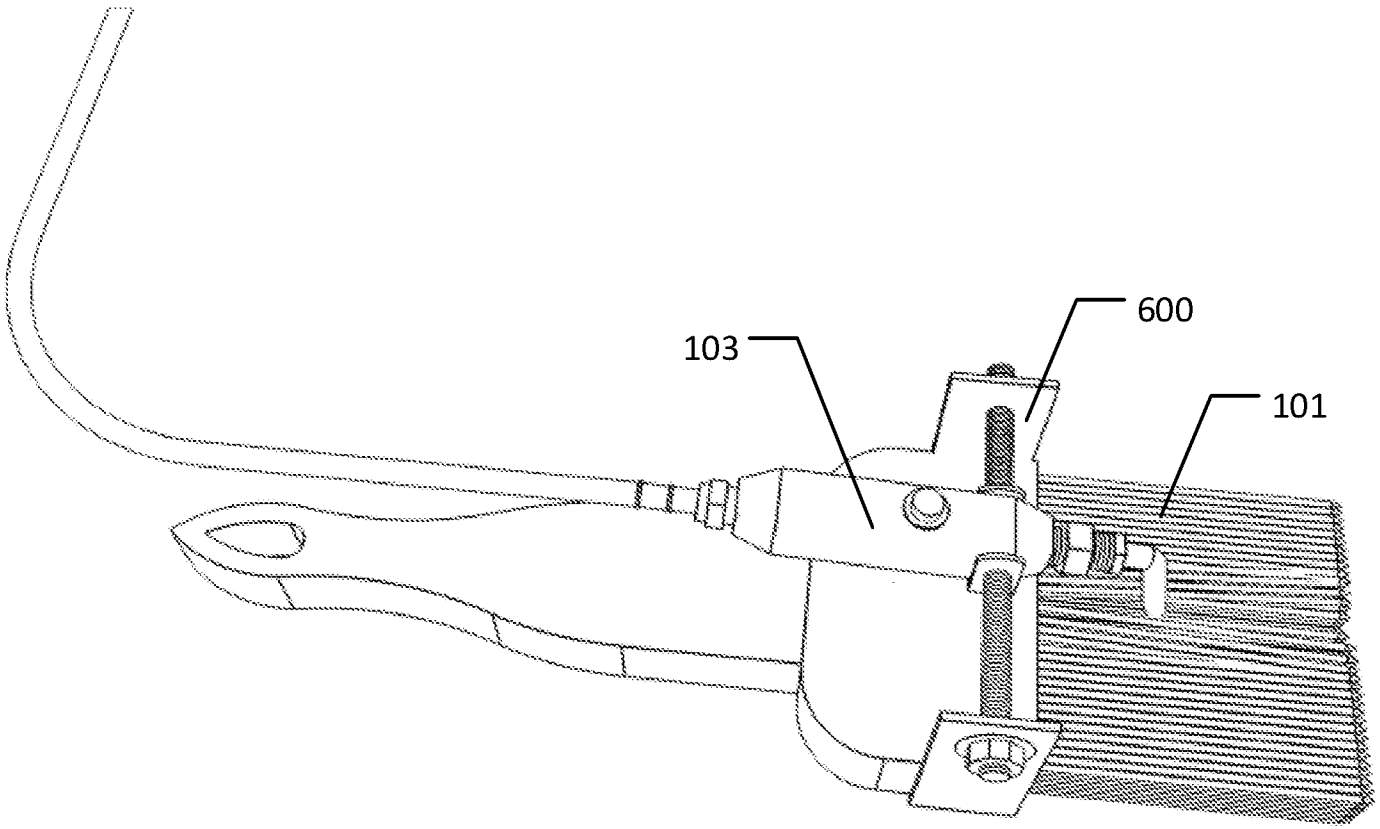
FIG. 12 illustrates how a paint-dispenser can be connected to a paintbrush.

FIG. 12 illustrates how paint-dispenser 103 can be connected to paintbrush 101. In an embodiment wherein paint-dispenser 103 can be mountable to paintbrush 101, paint-dispenser 103 can be positioned above the topside surface of paintbrush 101 such that paint-dispenser 103 can be aligned at the middle of paintbrush 103. Fastening device 600 can be adjusted to ensure that opening 504 of paint tube 503 is positioned within the center of the bristles of paintbrush 101. In another embodiment wherein paint-dispenser 103 is attachable to replaceable paintbrush head 801, paint tube 503 can be inserted within socket 805. In an embodiment wherein paintbrush head 801 comprises locks 806, paintbrush head 801 can be positioned such that locks 806 can be aligned with crevices 802 of paint-dispenser 103. In another embodiment wherein paintbrush head 801 comprises threaded socket 902, threaded portion 901 of paint-dispenser 103 can be inserted and screwed within threaded socket 902.

Figure 13:
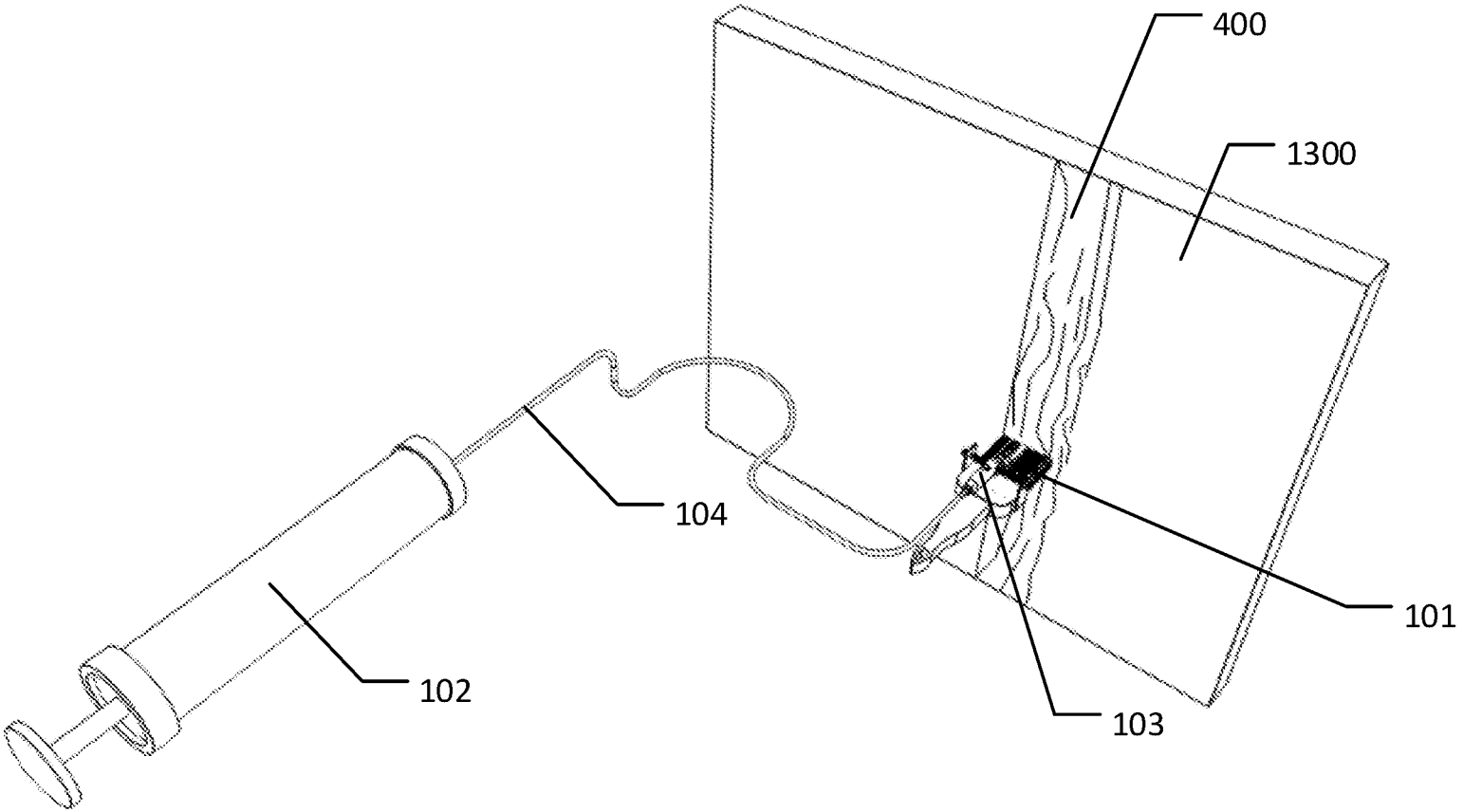
FIG. 13 illustrates how paint-dispenser can be used to apply paint on a surface.

FIG. 13 illustrates how paint-dispenser 103 can be used to apply paint 400 on a surface 1300. In an embodiment wherein removable hose 104 is used, hose-valves 1002 can first be opened to allow paint 400 to flow from container 102 to paint-dispenser 103. Once ready, paintbrush 101 or removable paintbrush head 801 can be positioned towards surface 1300. To apply paint 400, button 505 can be pushed to release paint 400 from paint-dispenser 103 to the bristles of paintbrush 101. Once button 505 is pushed, the pressure within container 102 can be released towards nozzle 205, as such biasing device 302 can expand towards nozzle 205 relative to the amount of paint 400 released from paint-dispenser 103.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A substantially cylindrical container comprising a first orifice at a front end of said container, said first orifice mounts a nozzle;

a second orifice at a bottom end of said container;

a void within said container that is fillable with paint;

a plunger comprising a ring, said plunger tightly fitted within said void;

a rod slidably mounted within said second orifice and said ring, wherein a front end of said rod positionable within said void; and a biasing device mounted to said rod such that said biasing device placed in between said bottom end and said plunger, said biasing device positionable into;

expanded state wherein said void is not filled with said paint; and retracted state wherein said void is filled with said paint, further wherein said biasing device moves relatively to the amount of paint that is placed within said void; and a paint-dispenser connectable with said container through a hose, said paint dispenser comprising a button, said button once actuated capable of releasing said paint to a paintbrush bristles.

2. The system of claim 1 wherein said rod comprises a cap, said cap is larger than said ring such that said plunger does not slip off of said rod, further wherein said cap is larger than said first orifice to prevent said rod from slipping out of said container.

3. The system of claim 1 wherein said void comprises a maximum fill capacity, said maximum fill capacity is equal to a space in said void created when said biasing device is at a maximum compressed state.

4. The system of claim 1 further comprising a fastening device, said fastening device mounts said paint dispenser on a topside surface of a paintbrush.

5. The system of claim 4 wherein said paint dispenser comprises a paint tube, said paint tube comprises flexible material that is bent in shape such that when said paint dispenser is mounted on said topside of said paintbrush said paint tube is positionable within paintbrush bristles.

6. The system of claim 1 said nozzle comprises a valve, wherein said valve prevents said paint from flowing when said hose is not connected.

7. The system of claim 1 wherein said bottom end comprises a removable lid.

8. The system of claim 1 wherein said biasing device comprises a spring.

9. The system of claim 1 wherein said hose removable from said container.

* * * * *